United States Patent [19]

Obayashi et al.

[11] 4,174,649

[45] Nov. 20, 1979

[54] ELECTRONIC MUSICAL INSTRUMENT

[75] Inventors: Nobuharu Obayashi, Kami; Hikaru Hashizume, Hamamatsu; Noriji Sakashita, Hamamatsu; Seiji Kameyama, Hamamatsu; Sadaaki Ezawa, Hamamatsu; Hironori Watanabe, Hamamatsu; Tatsunori Kondo, Hamamatsu; Toshio Kugisawa, Hamamatsu; Yutaka Washiyama, Fujieda, all of Japan

[73] Assignee: Kabushiki Kaisha Kawai Gakki Seisakusho, Hamamatsu, Japan

[21] Appl. No.: 842,523

[22] Filed: Oct. 17, 1977

[51] Int. Cl.[2] ..... G10H 1/00; G10H 5/00

[52] U.S. Cl. ..... 84/1.01

[58] Field of Search ..... 84/1.01

[56] References Cited

U.S. PATENT DOCUMENTS 3,844,379 10/1974 Tomisawa et al. ..... 84/1.01

3,979,989 9/1976 Tomisawa et al. ..... 84/1.01

*Primary Examiner*—Stanley J. Witkowski

[57] ABSTRACT

An electronic musical instrument which has a key assignor or assignors of one or more channels for generating and temporarily storing key code corresponding to key depression and release, respectively, a memory for storing waveshape information such as inclination and amplitude variations of a required musical waveshape divided into a plurality of periods so as to read out the waveshape information corresponding to the key code, a plurality of tone source devices, each including waveshape generators of different sound ranges respectively corresponding to keyboard switches in the same channel of each key assignor, the tone source device reading out the waveshape information from the memory on a time divided basis to generate from the waveshape generators waveshapes of different frequencies based on the read out waveshape information, and means for simultaneously actuating the corresponding waveshape generators by the key code from the key assignor and coupler information.

2 Claims, 4 Drawing Figures

ELECTRONIC MUSICAL INSTRUMENT

BACKGROUND OF THE INVENTION

1. Field of the Invention

This invention relates to an electronic musical instrument in which a key depression signal transferred in the form of a coded digital signal is applied to one or more tone source circuits and waveshape information of the sound range corresponding to the key depression signal is read out and processed to obtain a musical waveshape of the frequency corresponding to a selected key.

2. Description of the Prior Art

In recent years, there has been proposed for electronic musical instruments a tone source device of the type in which one cycle of a required musical waveshape is prestored in a waveshape memory and the waveshape stored therein is read out by a tone source clock signal having a repetitive cycle proportional to a scale frequency to obtain a musical waveshape of each scale frequency.

With this method, however, a faithful reproduction of a complicated musical waveshape, especially a sound of an actual musical instrument, will require a waveshape memory of a very large memory capacity. Further, in the case of constructing the abovesaid tone source device by a conventional one key-one generator method, the device itself will become inevitably bulky and complicated. Then, the assignee of the present application has proposed novel methods in Japanese Patent Applications Nos. 105861/74 and 139935/74 (now Pat. Disc. Numbers 32317/76 and 65928/76, respectively) for simplification of the former method. With these methods, one cycle of a required musical waveshape is divided by a straight-line approximation at irregular (Pat. Appln. No. 105861/74) or regular (Pat. Appln. No. 139935/74) time intervals into a plurality of periods and data such as inclination and amplitude variations and time information (Pat. Appln. No. 10586/74) of the waveshape of each period are stored in a memory. This remarkedly reduces the memory capacity used, and enables an increase in the number of quantizing steps with the small memory capacity, providing the advantage of alleviation of quantizing noise.

The tone source devices set forth in the abovesaid Japanese patent applicaions are advantageous for substantially faithful reproduction of a sound of an actual musical instrument. For simultaneous generation of a plurality of sounds which is peculair to the electronic musical instrument, however, it is necessary to provide a plurality of waveshape memories, which inevitably introduces bulkiness in the device.

To avoid the abovesaid defect, the assignee of the present application has further proposed a novel method of Japanese Patent Application No. 79673/75 (now Pat. Disc. No. 3421/77). With this method, one cycle of a required musical waveshape is divided into a plurality of periods and information such as inclination and amplitude variations of the waveshapes of each period is stored in a memory and read out therefrom on a time shared basis, by which waveshapes of different frequencies can be simultaneously obtained based on each waveshape information. In this manner, a plurality of sounds can be simultaneously produced without the necessity of increasing the memory capacity used.

Further, the assignee of the present application has proposed in Japanese Patent Application No. 96035/75 (now Pat. Disc. No. 45322/77) improvements in the key assignor method in which a key depression or release signal sent out in the form of a coded digital signal is selectively applied to tone source circuits.

Moreover, since the frequency spectrum contained in a musical waveshape of an actual instrument sound differs for each sound range, it is difficult to simply approximate the instrument sound with one musical waveshape.

SUMMARY OF THE INVENTION

This invention has for its object to provide an electronic musical instrument which has a tone source device adapted to be capable of faithful reproduction of an actual instrument sound in consideration of the fact that the frequency spectrum of a musical waveshape differs for each sound range.

The abovesaid objective can be achieved by providing an electronic musical instrument which comprises a key assignor or assignors of one or more channels for generating and temporarily storing key code corresponding to key depression and release, a memory for storing inclination and amplitude variations of a required musical waveshape divided into a plurality of periods so as to read out the waveshape information corresponding to the key code, a plurality of tone source devices, each including waveshape generators of different sound ranges respectively corresponding to keyboard switches in the same channel of each key assignor, the tone source device reading out the information from the memory on a time divided basis to generate from the waveshape generators waveshapes of different frequencies based on the read out waveshape information, and means for simultaneously actuating the corresponding generators by the key code from the key assignor and coupler information.

DESCRIPTION OF THE PREFERRED EMBODIMENTS

Figure 1:
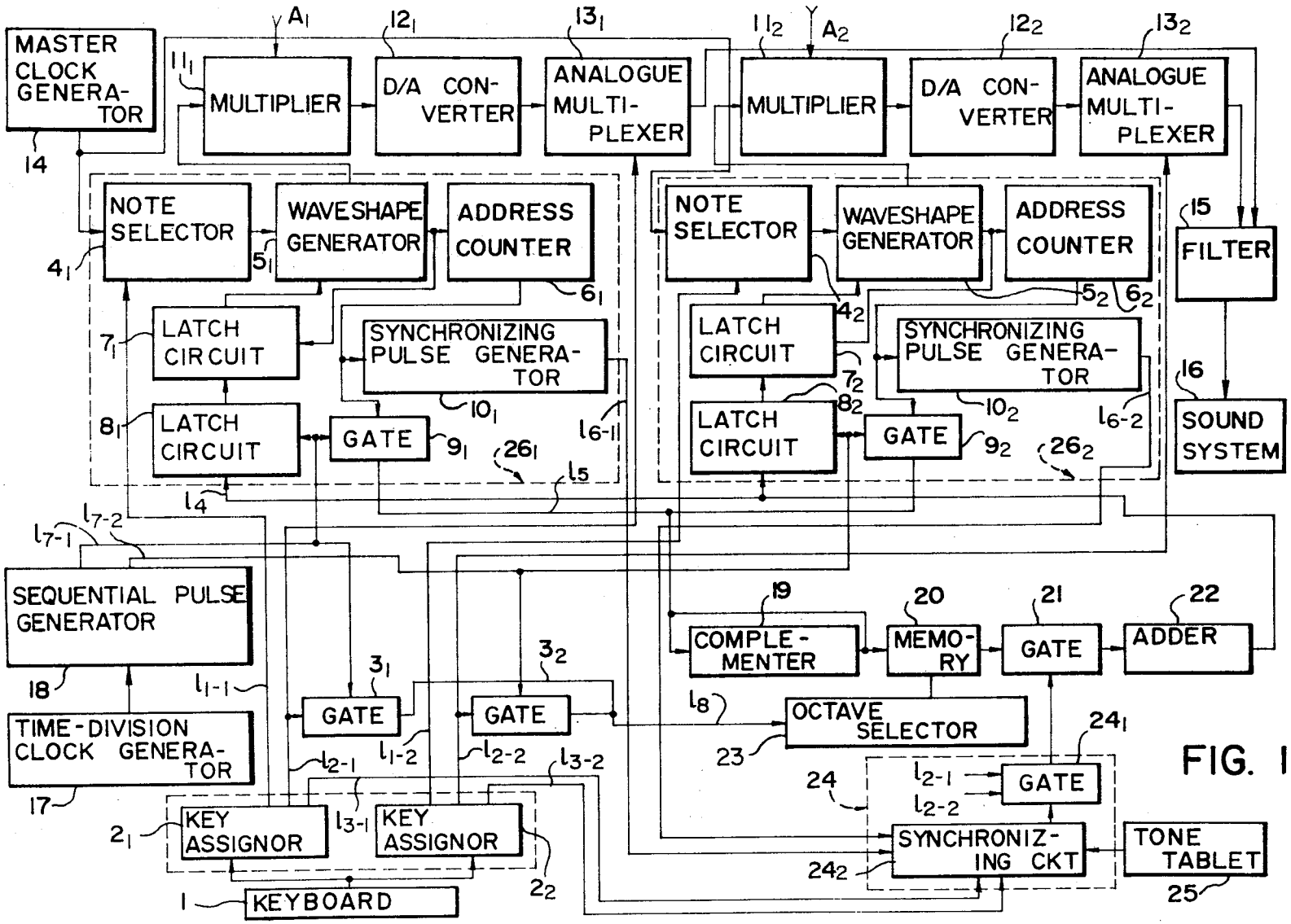
FIG. 1 is a block diagram showing an embodiment of this invention.

FIG. 1 is a block diagram of an embodiment of this invention, illustrating the construction of an electronic musical instrument having key assignors of two channels. In FIG. 1, a key signal from a keyboard 1 is divided by plural, for instance, two key assignors $\mathbf{2}_1$ and $\mathbf{2}_2$, into two channels according to the sound range of the key signal. The key code from each of the key assignors $\mathbf{2}_1$ and $\mathbf{2}_2$ includes note, octave and keyboard codes, which are provided on lines $l_{1-1}$ and $l_{1-2}$, lines $l_{2-1}$ and $l_{2-2}$ and lines $l_{3-1}$ and $l_{3-2}$, respectively. The keyboard code mentioned above is information indicating whether or not the key assignor has captured the key code from the keyboard 1. A sequential pulse generator 18 is actuated by a clock from a time division clock generator 17 to apply a sequential pulse $T_1$ via a line $l_{7-1}$ to a gate $\mathbf{3}_1$, in which the octave code is time divided and the output from which is supplied to an octave selector 23 via an octave bus line $l_8$.

The octave selector 23 is formed with a decoder to actuate selectively memories of a memory circuit 20 which have the word numbers corresponding to respective sound ranges. In the memory circuit 20, there are prepared waveshape data of one cycle for each octave with the word number corresponding thereto. With the output from a tone source device $26_1$, memory addresses of different word numbers for the respective sound ranges (as shown in the following Table 1) are selectively assigned. The number of bits X of the supply lines from the tone source device are also shown in the table.

Table 1

| Sound range | Word number | Line $l_5$ supply bit |
|---|---|---|
| $C_7 \sim C_6\#$ | m words | (X-5) bits |
| $C_6 \sim C_5\#$ | 2m words | (X-4) bits |
| $C_5 \sim C_4\#$ | 4m words | (X-3) bits |
| $C_4 \sim C_3\#$ | 8m words | (X-2) bits |
| $C_3 \sim C_2\#$ | 16m words | (X-1) bits |
| $C_2$ | 32m words | X bits |

Then, the note code $l_{1-1}$ is applied from the key assignor $2_1$ to a note selector $4_1$ to select the note clock corresponding to the note code from clock frequencies which are applied from a master clock generator 14 to the note selector $4_1$. If the sound ranges in Table 1 are $C_2$ to $C_7$, the master clock generator 14 generates a clock m x n x ($C_7 \sim C_6\#$), where m is the memory word number corresponding to the highest sound range ($C_7 \sim C_6\#$) as shown in Table 1 and n is the clock number of one cycle of a waveshape generator $5_1$ provided at the next stage. The output from the note selector $4_1$ is frequency divided by the waveshape generator $5_1$ down to 1/n and is applied to an address counter $6_1$. Assuming that m=4, the address counter $6_1$ is formed with a 128-step counter since $4 \times 32 = 128$. The address counter $6_1$ counts the clock m x ($C_7 \sim C_6\#$) frequency divided by the waveshape generator $5_1$ down to 1/n. The output from the address counter $6_1$ is applied to a gate $9_1$ to provide the time division clocks $T_1$ and $T_2$ corresponding to respective channels. The output signal from the address counter $6_1$ is time divided by the time division clock $T_1$, thereafter being supplied via an address bus line $l_5$ to the abovesaid memory circuit 20 together with signals of other channels. At the same time, the output from the address counter $6_1$, is branched to be applied to a synchronizing pulse generator $10_1$, which supplies one pulse to a synchronizing circuit 24 at each cycle of the address counter $6_1$. A complementer 19 is provided for storing the half cycle of the waveshape data in the memory circuit 20, if necessary, and, in such an instance, by repetitively reading out the waveshape data of the half cycle from the memory circuit 20, the same operation as that in the case of the waveshape data of one cycle being stored can be performed.

In this manner, a memory address is assigned in accordance with the output from the address counter $6_1$ and a memory assignment is achieved by the octave code, so that a memory part of the word number corresponding to the octave is read out by the time division clock $T_1$. With one cycle of the output from the address counter $6_1$, the octave sequentially lowers and, at the same time, the word number sequentially increases by 2 m, as shown in Table 1. Thus, octave frequency division takes place.

Figure 2:
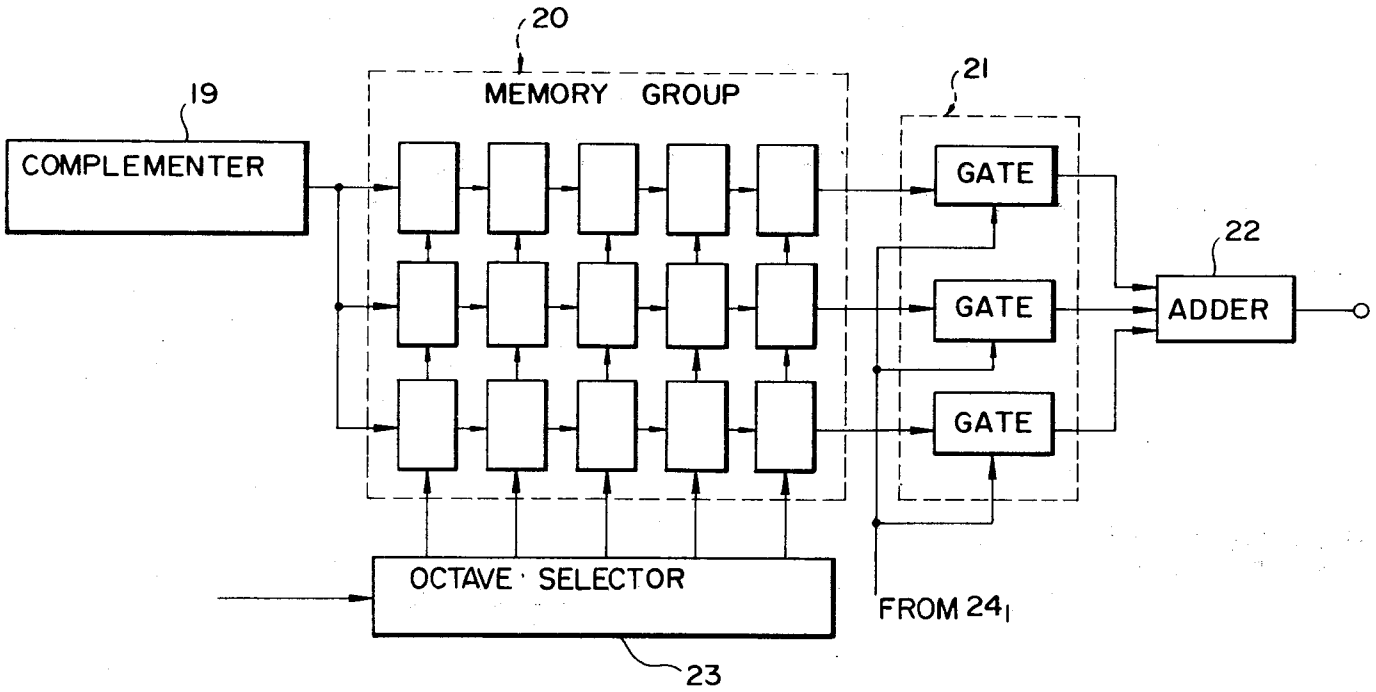
FIG. 2 is a block diagram illustrating a memory 20 used in FIG. 1, together with a complementer 19, a gate 21 and an adder 22 associated therewith.

The data read out in this cycle are provided via a gate 21 to an adder 22. Where a certain key is captured by the key assignor $2_1$, the time division clock $T_1$ corresponding thereto is applied from the synchronizing circuit $24_2$ to the gate 21 through a gate $24_1$, reading out the data from the memory circuit 20. The synchronizing circuit $24_2$ is supplied with an ON-OFF signal from a tone tablet or tone switch box 25. Further, a signal indicating whether or not the key assignor $2_1$ has captured key code and the synchronizing signal from the synchronizing pulse generator $10_1$ are applied to the synchronizing circuit $24_2$ via lines $l_{3-1}$ and $l_{6-1}$, respectively. The synchronizing circuit $24_2$ is formed with a D type flip-flop, which is cleared by the signal from the line $l_{3-1}$ and supplied at its D terminal with the control signal from the tone tablet 25. When the synchronizing signal from the line $l_{6-1}$ is applied to the clock terminal of the flip-flop, "1" is written in the flip-flop and is applied to the gate $24_1$, providing the corresponding time division clock $T_1$ to the gate 21. In the case where the memory circuit 20 is composed of a plurality of memories as shown in FIG. 2, the gate 21 is also formed with a plurality of gates correspondingly and the adder 22 is designed so that the outputs from the plurality of gates are added together.

The time divided data corresponding to the memory output data are applied via a data bus line $l_4$ to a first latch circuit $8_1$. Since the latch circuit $8_1$ performs latching with the same pulse $T_1$ as the time division pulse of the gate $9_1$, the data corresponding to the channel of the pulse $T_1$ are latched in the latch circuit $8_1$. The data are latched by the output clock of the waveshape generator $5_1$ in a second latch circuit $7_1$ in synchronism with the musical waveshape, and the waveshape data are applied to the waveshape generator $5_1$. Thus, the waveshape data are sequentially read out of the memory circuit 20 corresponding to the count value of the address counter $6_1$ to provide the musical waveshape from the waveshape generator $5_1$.

The musical waveshape from the waveshape generator $5_1$ is applied to a multiplier $11_1$, in which it is given an envelope waveshape $A_1$ to provide a musical waveshape close to that of an actual musical instrument tone. The output from the multiplier $11_1$ is fed to a D-A converter $12_1$ to provide an analog musical waveshape, which is supplied to an analog multiplexer $13_1$ and is applied therefrom by the octave code $l_{2-1}$ from the key assignor $2_1$ to a filter 15 of the cutoff frequency corresponding to each sound range, thereafter being fed to a sound system 16.

The above has described the construction and the operation of a first channel which is composed of the key assignor $2_1$, the gate $3_1$, the tone source circuit $26_1$ including the waveshape generator $6_1$, etc. and the memory circuit 20 and other circuits provided in common to the first and second channels. A second channel, composed of the key assignor $2_2$, the tone source circuit $26_2$, a gate $3_2$, the multiplier $11_2$, a DA converter $12_2$ and an analog multiplexer $13_2$, is identical in construction with the first channel. The source circuit $26_2$ includes the note selector $4_2$, the wave shape generator $5_2$, the address counter $6_2$, the latch $7_2$, and $8_2$, the synchronizing pulse generator $10_2$ and the gate $9_2$. An envelope wave shape $A_2$ is given to the multiplier $11_2$. The operation and construction of the items in the second channel are identical with those previously described in connection with the first channel where a key other than that whose information has been captured by the key assignor $2_1$ is depressed on the keyboard, the key information of the key is captured by the key assignor $2_2$. However, the operation will be the same. The suffixes 1 and 2 indicate the first and second channels, respectively. In short, the key code from the key assignor is divided into two to provide the contents corresponding thereto in the memory circuit and the waveshape information corresponding to the key code of a selected key can be obtained independently of or in combination with each other.

Although the foregoing embodiment has been described in connection with the case of octave division into two channels, this invention is not limited specifically to the above and the octave division into a desired number of blocks can be easily achieved by providing three or more channels and appropriately changing the key code of the key assignors $2_1$ and $2_2$ which is applied to the octave selector 23 and the note selectors $4_1$ and $4_2$.

As described above, according to this invention, a required musical waveshape is divided into a plurality of sound ranges and information of inclination and amplitude variations of the waveshape in each sound range is stored in individual memories, so that the capacity of each memory may be small and the frequency spectrum can be set at will which differs for each sound range. Consequently, it is possible to produce a sound closer to that of an actual musical instrument, as compared with an electronic musical instrument of a single channel.

Figure 3:
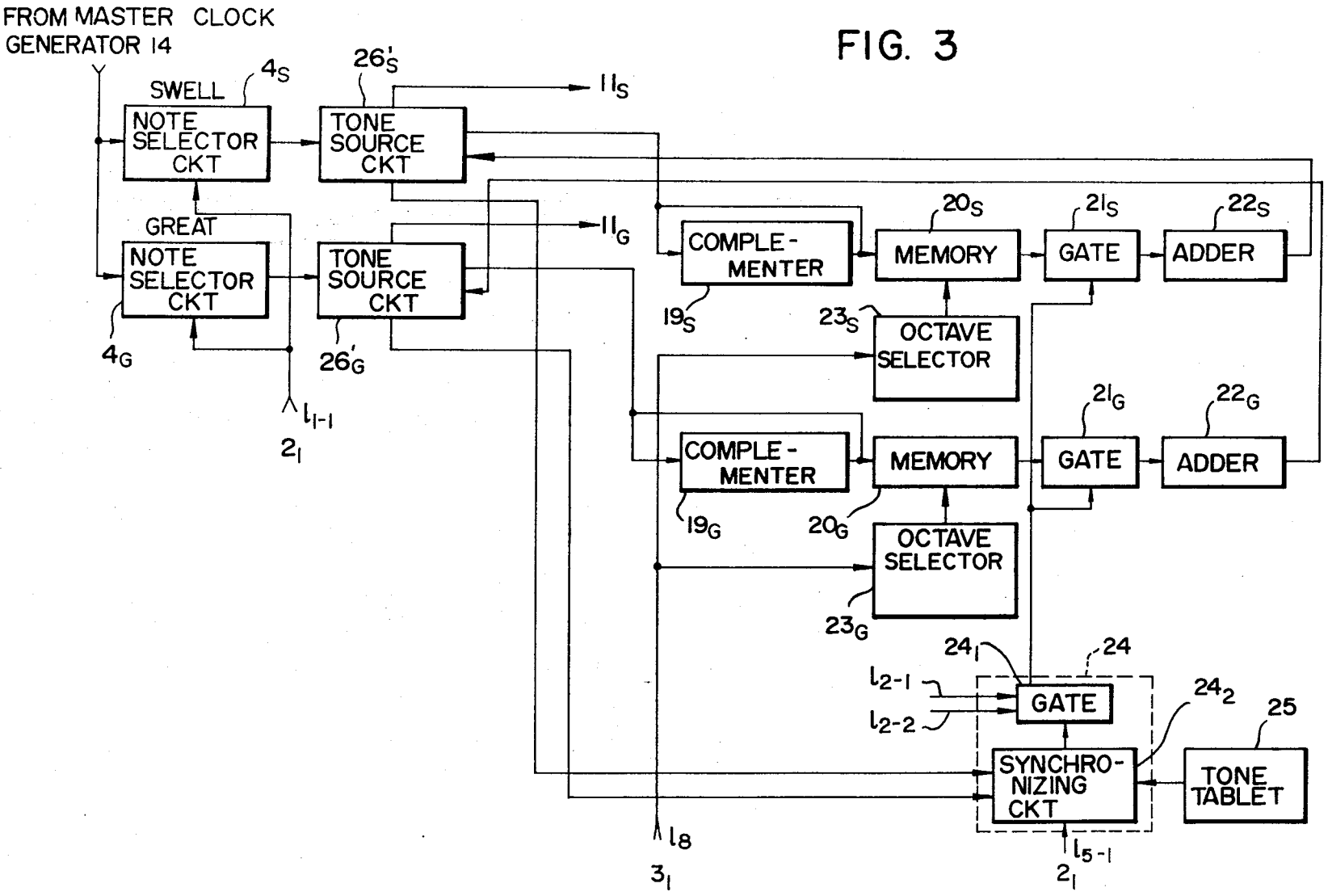
FIG. 3 is a block diagram showing another embodiment of this invention.

FIG. 3 is a block diagram illustrating the structure of another embodiment of this invention. The tone source $26_1$ of the first channel in FIG. 1 is divided into two, i.e. swell and great series. Accordingly, the master clock generator 14 is connected in parallel with note selectors $4_S$ and $4_G$ and other tone source circuits $26'_S$ and $26'_G$ of the swell and great series, respectively. The note code is applied via the line $l_{1-1}$ from the key assignor $2_1$ to the note selectors $4_S$ and $4_G$ and musical waveshapes are provided from the tone source circuits $26'_S$ and $26'_G$ to multipliers $11_S$ and $11_G$ of the two series.

The tone source circuits $26'_S$ and $26'_G$ are respectively connected to complementers, memory circuits, gates and adders $19_S$ to $22_S$ and $19_G$ to $22_G$ of the two series via the lines corresponding to the line $l_5$ in FIG. 1, and memory data are read out via the lines corresponding to the line $l_4$ in FIG. 1. To octave selectors $23_S$ and 23hd G respectively connected with the memory circuits $20_S$ and $20_G$ are each applied the octave code from the gate $3_1$ via the lines corresponding to the line $l_8$ in FIG. 1. The synchronizing circuit $24_2$ in the broken-line block 24 is supplied with synchronizing pulses from the tone source circuits $26'_S$ and $26'_G$ through the lines corresponding to the line $l_{6-1}$ in FIG. 1, respectively, providing outputs in parallel to the gates $21_S$ and 21hd G from the gate $24_1$. With such an arrangement, when coupler information is inputted by pressing a coupler switch (SW to GR) to the synchronizing circuit $24_2$ from the tone tablet 25, if only the great (GR) series has been operative until then, the corresponding waveshape generator is also actuated by the key code from the key assignor, whereby musical waveshapes of the two series can be selected.

Figure 4:
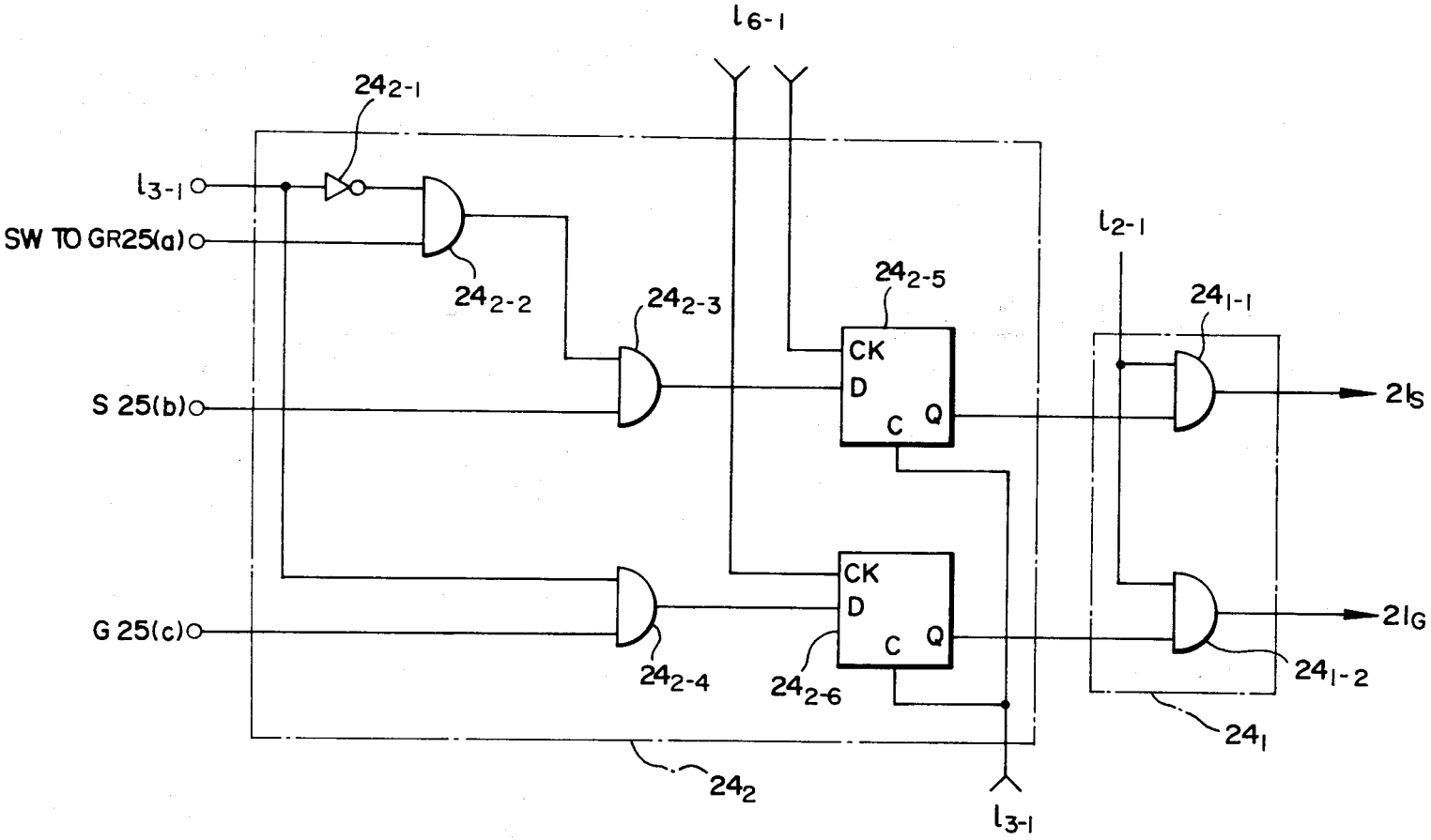
FIG. 4 shows in detail examples of a gate $\mathbf{24}_1$ and a synchronizing circuit $\mathbf{24}_2$ employed in FIG. 3.

FIG. 4 illustrates in detail examples of the synchronizing circuit $24_2$ and the gate $24_1$ of the first channel.

In FIG. 4, terminals 25(*a*), 25(*b*) and 25(*c*) of the tone tablet 25 connected to the synchronizing circuit $24_2$ are a (coupler) switch (SW to GR), a swell terminal and a great terminal, respectively. The input on the line $l_{3-1}$ from the key assignor $2_1$, inverted by an inverter $24_{2-1}$, and the tablet input at the terminal 25(*a*) are applied via an AND gate $24_{2-2}$ to an AND gate $24_{2-3}$ together with the tablet input at the terminal 25(*b*) and the output from the AND gate $24_{2-3}$ is supplied to the D terminal of a D type flip-flop $24_{2-5}$.

On the other hand, the input on the line $l_{3-1}$ and the input at the terminal 25(*c*) are applied to an AND gate $24_{2-4}$, the output from which is provided to the D terminal of a D type flip-flop $24_{2-6}$.

To the CK terminals of the D type flip-flops $24_{2-5}$ and $24_{2-6}$ are applied the synchronizing pulse via the line $l_{6-1}$ from the aforesaid tone source circuits of the two series. The clear terminals of these flip-flops are connected to the line $l_{3-1}$. The Q outputs from the flip-flops $24_{2-5}$ and $24_{2-6}$ are respectively supplied to AND gates $24_{1-1}$ and $24_{1-2}$ in the gate $24_1$ together with the time division clock $T_1$ on the line $l_{2-1}$ from the key assignor $2_1$. The outputs from the AND gates $24_{1-1}$ and $24_{1-2}$ are provided to the gates $21_S$ and $21_G$, respectively.

The operation of the above construction will be described. Let it be assumed that a key code "0" is provided to the terminal 25(*a*) from the line $l_{3-1}$ by the operation of the tone tablet 25 when the coupler switch (SW to GR) is depressed in the case where the key assignor of the first channel is in the mode of great (GR). In such an instance, "1" is derived at the output of the AND gate $24_{2-2}$ through the inverter $24_{2-1}$ and if "1" is provided at the terminal 25(*b*), that is, if the tone tablet of the swell (SW) is in the ON state ("1"), "1" is provided at the output of the AND gate $24_{2-3}$. As a result of this, "1" is applied to the D terminal of the D type flip-flop $24_{2-5}$ and when the synchronizing pulse from the tone source circuit $26'_S$ provides "1" at the CK terminal of the flip-flop $24_{2-5}$, "1" is derived at the Q terminal. Further, the time division clock $T_1$ from the line $l_{2-1}$ is applied from the AND gate $24_{1-1}$ to the gate $21_S$ to read out memory data from the memory circuit $20_S$ of the swell (SW) series. At the same time, the swell (SW) is seized by the key assignor $2_1$, so that the key code "1" is provided on the line $l_{3-1}$ and if "1" is provided at the terminal 25(*c*), that is, if the tone tablet of the great (GR) is in the ON state ("1"), the output from the AND gate $24_{2-4}$ becomes "1", and consequently the output at the Q terminal of the D type flip-flop $24_{2-6}$ also becomes "1". Further, the time division clock $T_1$ from the line $l_{2-1}$ applied to the gate $21_G$ through the AND gate $24_{1-2}$ to read out memory data from the memory circuit $20_G$ of the great (GR) series.

Where the key assignors do not capture any key code at the clear terminals of the D type flip-flops $24_{2-5}$ and $24_{2-6}$, the flip-flops are cleared and the time division clock $T_1$ is applied to the gates $21_S$ and $21_G$ through gates $24_1$ and $24_2$.

As has been described in the foregoing, according to this invention, a plurality of tone source devices, each including waveshape generators of different sound regions corresponding to keys, are provided in the same channel of a key assignor of one channel or each of key assignors of two or more channels. The waveshape generators of the swell (SW) and great (GR) series can be actuated by the key code from the key assignor and the coupler information not only individually but also simultaneously, as mentioned previously. This invention is very effective for obtaining a musical waveshape which is close to that of an actual musical instrument.

It will be apparent that many modifications and variations may be effected without departing from the scope of the novel concepts of this invention.

What is claimed is:

1. An electronic musical instrument having a keyboard with a plurality of keys, comprising:

a key assignor for generating and temporarily storing a key code corresponding to the depression and release of a key, respectively, a memory circuit for storing inclination and amplitude variations of a required musical waveshape divided into a plurality of periods for reading out the waveshape information corresponding to the key code; and a tone source device for reading out the information from the memory circuit on a time divided basis to thereby simultaneously obtain waveshapes of different frequencies with the frequencies based on the time division;

wherein the tone source device divides the key code from the key assignor into a plurality of time divided channels and includes waveshape generators of different sound ranges in each of the channels, and wherein there is provided means for reading out the waveshape information from the memory circuit corresponding to the divided information, respectively.

2. An electronic musical instrument according to claim 1, wherein there are provided a plurality of tone source devices, each including waveshape generators of different sound ranges respectively corresponding to the keys whose key codes are in the same channel, and wherein there is provided means of simultaneously actuating by means of a key code from the key assignor those of the waveshape generators corresponding to that key code.

* * * * *